US007004167B2

(12) United States Patent
Cheng

(10) Patent No.: US 7,004,167 B2
(45) Date of Patent: Feb. 28, 2006

(54) FACEMASK HAVING AN AROMATIC CAPSULE

(76) Inventor: Yung-Chu Cheng, 19F-3, No. 508, Sec. 5, Chung Hsiao E. Rd., Hsin I Dist., Taipei (TW)

( * ) Notice: Subject to any disclaimer, the term of this patent is extended or adjusted under 35 U.S.C. 154(b) by 0 days.

(21) Appl. No.: 10/963,499

(22) Filed: Oct. 14, 2004

(65) Prior Publication Data

US 2005/0081856 A1 Apr. 21, 2005

(30) Foreign Application Priority Data

Oct. 16, 2003 (CN) ..... 200320100937

(51) Int. Cl.
*A62B 23/02* (2006.01)
*A62B 18/02* (2006.01)

(52) U.S. Cl. ..... 128/206.19; 128/205.27

(58) Field of Classification Search ..... 128/205.25, 128/205.27, 205.29, 206.12, 206.18, 206.19, 128/206.21, 206.26, 206.28, 207.13; 2/91, 2/206, 424, 901

See application file for complete search history.

(56) References Cited

U.S. PATENT DOCUMENTS

| | | | | | |
|---|---|---|---|---|---|
| 4,503,851 | A * | 3/1985 | Braunroth | ..... | 128/203.29 |
| 4,790,307 | A * | 12/1988 | Haber et al. | ..... | 128/206.19 |
| 5,243,708 | A * | 9/1993 | Vanuch | ..... | 2/206 |
| 5,538,013 | A * | 7/1996 | Brannon | ..... | 128/857 |
| 5,636,628 | A * | 6/1997 | Barnum | ..... | 128/206.12 |
| 5,697,105 | A * | 12/1997 | White | ..... | 2/206 |
| 6,070,578 | A * | 6/2000 | Baughman et al. | .... | 128/205.27 |
| 6,758,215 | B1 * | 7/2004 | Begum | ..... | 128/203.29 |
| 2004/0244793 | A1 * | 12/2004 | Wedel | ..... | 128/200.24 |

* cited by examiner

*Primary Examiner*—Teena Mitchell
(74) *Attorney, Agent, or Firm*—Rosenberg, Klein & Lee

(57) ABSTRACT

A facemask having an aromatic capsule has a mask body having an inner cover layer and an outer cover layer, at least one press-to-crack aromatic capsule held fixed within the inner cover layer and the outer cover layer, and is provided with fragrance therein, and two bands disposed at the two sides of the mask body.

7 Claims, 3 Drawing Sheets

FACEMASK HAVING AN AROMATIC CAPSULE

BACKGROUND OF THE INVENTION

1. Field of the Invention

The present invention is related to facemasks having aromatic capsules, and more particularly, to a facemask having a press-to-crack aromatic capsule fixed within the facemask thereof, such that the facemask releases fragrances, dissolves unfavorable odors, and renews vigor through aromatherapy.

2. Description of Related Art

Facemasks are commonly used for separating the respiratory system of the wearer from the outside environment to prevent them from breathing in viruses, bacteria, or polluted air, thus filtering out viruses and bacteria making air cleaner for the wearer.

Refer to FIG. 1, which illustrates a partially exploded perspective diagram of a conventional facemask. The conventional facemask has a mask body 10 and two bands 30 disposed at the two sides of the mask body 10. The mask body 10 consists of an outer cover layer 10*a* and an inner cover layer 10*b*. To enhance the functions of the facemask, various filtration layers such as activated carbon layers for adsorbing unfavorable smells are added to the outer cover layer 10*a* and the inner cover layer 10*b*.

However, after being used for a period of time, the conventional facemask is liable to produce some unfavorable smells due the exhalations of the wearer. Moreover, breathing is impeded due to the multitude of layers of the mask. Over a period of time this causes the wearer to become dazed and unable to concentrate, thus affecting their work and/or ability to operate a vehicle safety.

Therefore, the inconvenience and disadvantages of the conventional facemask are intended to be improved.

SUMMARY OF THE INVENTION

The objective of the present invention is to provide a facemask with aromatic capsules, which a wearer can use the aromatic capsule placed therein when needed so that the wearer may enjoy a pleasant scent, avoid unfavorable odors, and maybe become revitalized.

To achieve the objective described above, this invention provides a facemask having aromatic capsules, wherein the facemask comprises a mask body having an inner cover layer and an outer cover layer, and with at least one press-to-crack aromatic capsule held fixed in between the inner cover layer and the outer cover layer, and two bands disposed at the two sides of the mask body. The aromatic capsule is provided with the fragrance therein.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
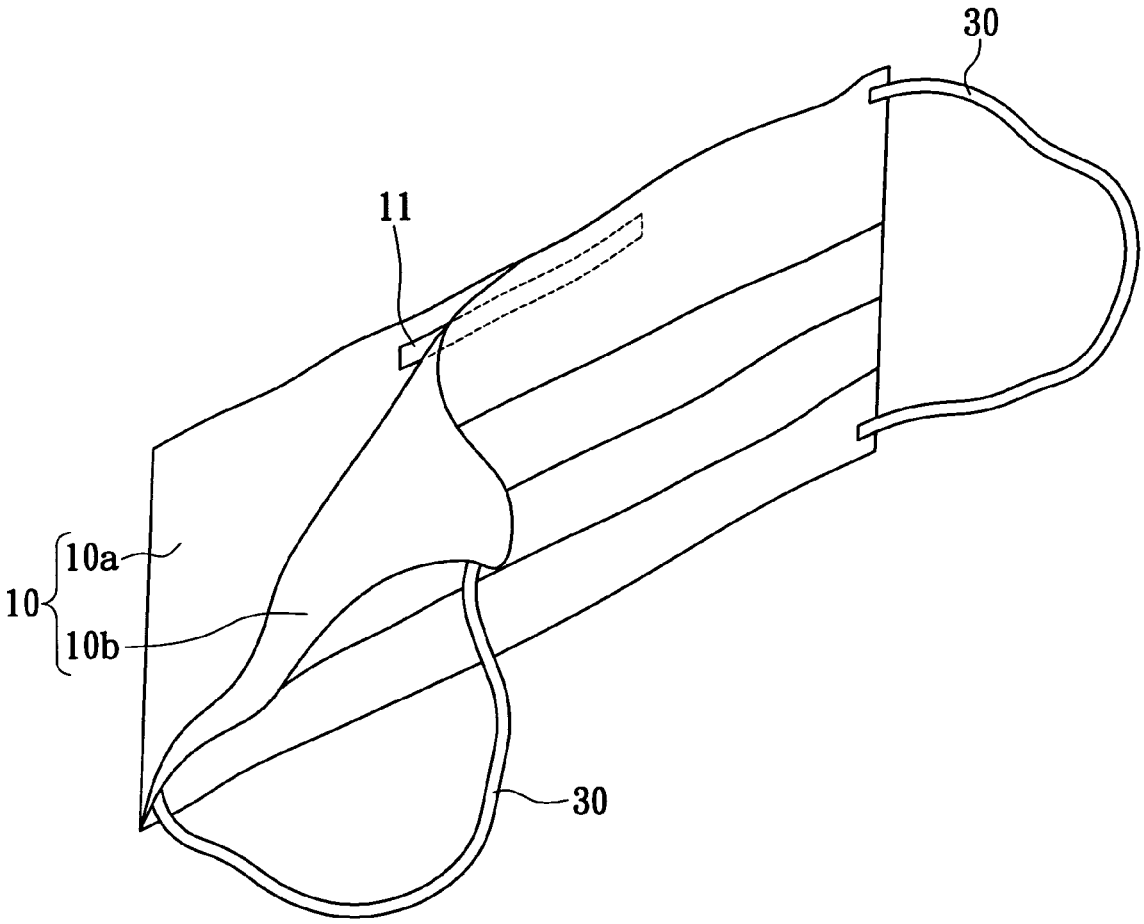
FIG. 1 PRIOR ART
FIG. 1 is a partially exploded perspective of a conventional facemask.
Figure 2:
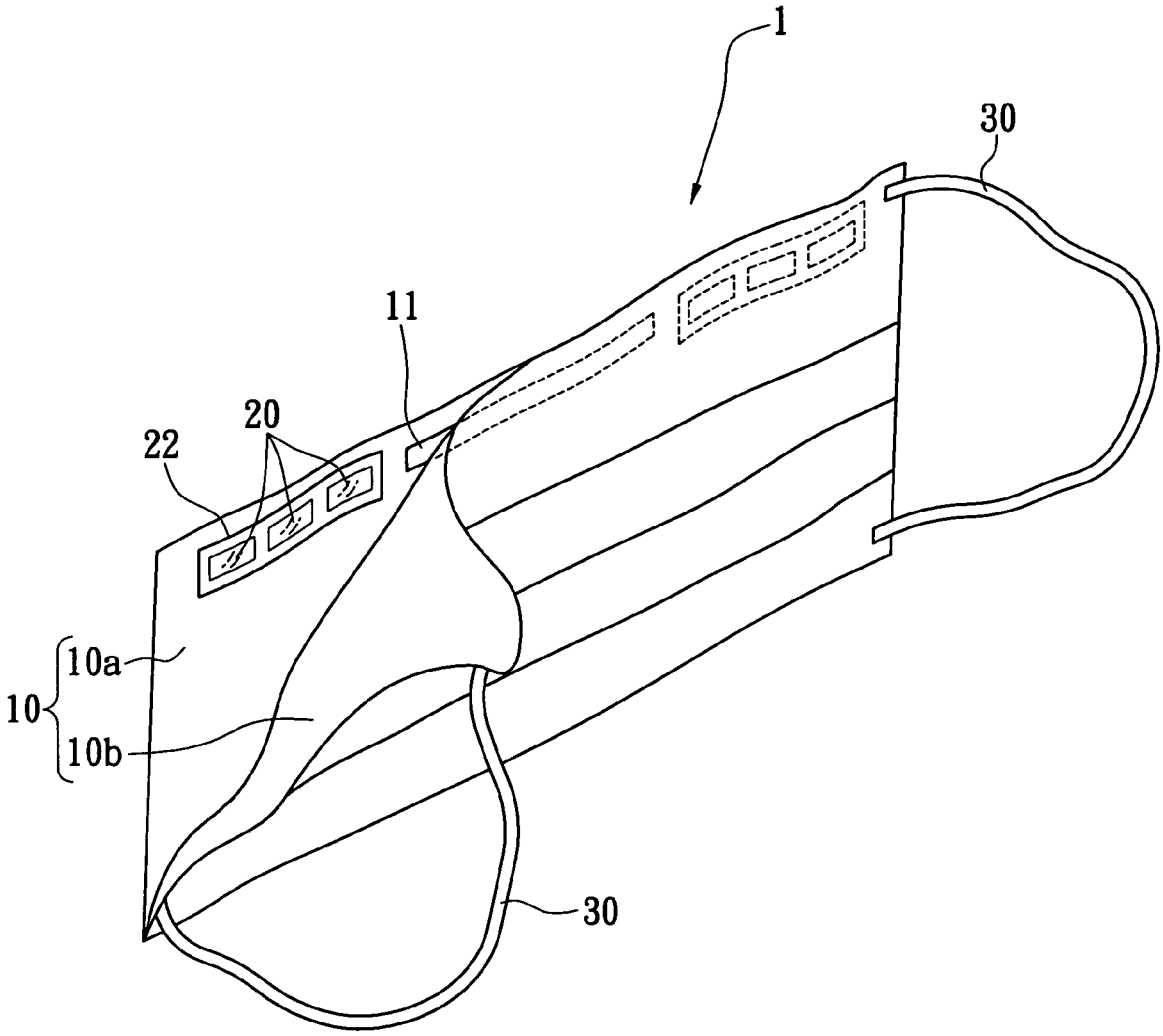
FIG. 2 is a partially exploded perspective showing the facemask having an aromatic capsule in accordance with this invention.

Referring to FIG. 2, a facemask 1 having an aromatic capsule provided by this invention comprises a mask body 10 having an outer cover layer 10*a* and an inner cover layer 10*b*, and a respective band 30 disposed at the two sides thereof for looping around the ears of the wearer. A bridge attachment piece 11 is disposed on the mask body 10 to enable the facemask 1 to be more closely fitted to the bridge of the nose of the wearer, such that the facemask is able to filtrate air efficiently.

This invention is characterized by a plurality of aromatic capsules 20 provided with the mask body 10, either within or outside the mask body 10. Most preferably, the plurality of aromatic capsules 20 is provided between the outer cover layer 10*a* and the inner cover layer 10*b* as shown in FIG. 2. Alternatively, a fixer 22 in transverse bar shape for wrapping around and positioning the plurality of aromatic capsules 20 is placed between the outer cover layer 10*a* and the inner cover layer 10*b* through binding or stitching. The plurality of aromatic capsules 20 can be placed fixed at the two ends of the bridge attachment piece 11 or fixed adjacent to the nostrils. Since the aromatic capsule 20 is small, the wearer's breathing will not be affected.

Figure 3:
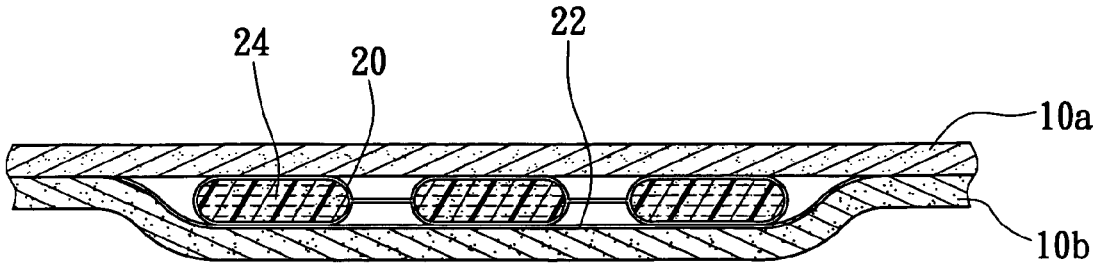
FIG. 3 is a cross-sectional view along the transverse of the aromatic capsule of the facemask in accordance with this invention.
Figure 4:
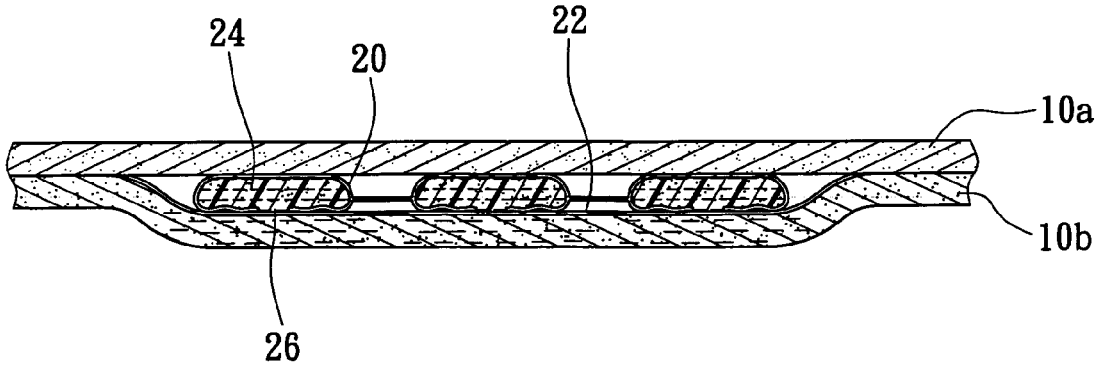
FIG. 4 is a schematic diagram showing the aromatic capsule of FIG. 3 after it has been pressed.

Referring to FIGS. 3 and 4, the aromatic capsule 20 is sealed ordinarily so as to prevent the aroma from dissipating. The material used for the capsules can be easily snapped open when pressed upon. Each aromatic capsules 20 can further be filled with adsorbent 24 for adsorbing liquid fragrances. Before wearing the facemask, the wearer presses the aromatic capsule 20 so that the fragrance contained in the aromatic capsule 20 starts its gradually release. Since the material of the mask body 10 is also liquid absorbable, the closing part 26 of the aromatic capsule 20, which is also the cracked part 26 when pressed, can be placed inside the facemask adjacent to the inner cover layer 10*b*. When the aromatic capsule 20 is cracked, the fragrance is adsorbed by the inner cover layer 10*b* of the mask body 10 as to be nearer to the wearer.

The facemask having an aromatic capsule of this invention is not limited to the planar type facemasks. Any type of facemask in which an aromatic capsule can be sandwiched between the layers of the facemask can use this invention.

Furthermore, the facemask having an aromatic capsule of this invention can contain a fragrance component able to adsorb and dissolve unfavorable odors. Moreover, it can even contain sterilization components. When the conventional facemask collects sweat or other bodily fluids and is giving off unfavorable odors, the aromatic capsule 20 can be pressed to adsorb and dissolve the unfavorable odors to provide the wearer with a more pleasant smell, and thus making the wearer feel more comfortable and in better mood. Moreover, because the fragrance is stored in the capsule to keep from dissipating, the storage life of this facemask is simultaneously prolonged. In addition, since breathing is somewhat affected when wearing the facemask, the aromatic capsule may contain revitalizing fragrance component such as mint, camphor or borneol to reinvigorate the wearer. For example, when operating surgeons have to wear facemasks for a long time and are unable to take them off, then they can press the aromatic capsule to reenergize themselves. Alternatively, when riding a motorcycle, the wearer can press the aromatic capsule if they are feeling tired or unable to concentrate well.

The invention may be embodied in other specific forms without departing from the sprit or essential characteristics thereof. The present embodiments are therefore to be considered in all respects as illustrative and not restrictive, with the scope of the invention being indicated by the appended claims rather than by the foregoing description and all changes which come within the meaning and range of equivalency of the claims are therefore intended to be embraced therein.

What is claimed is:

1. A facemask having an aromatic capsule, comprising:

a mask body, having an inner cover layer and an outer cover layer;

at least one press-to-crack aromatic capsule, fixed between said inner cover layer and said outer cover layer and provided with a liquid fragrance therein, said aromatic capsule is filled with an adsorbent for adsorbing said liquid fragrance and gradual release thereof, said aromatic capsule having a frangible closing part disposed adjacent said inner cover layer for absorption by said inner cover layer of said liquid fragrance released from said aromatic capsule; and two bands disposed at the two sides of said mask body.

2. The facemask having an aromatic capsule as claimed in claim 1, wherein said at least one aromatic capsule is provided between said inner cover layer and said outer cover layer.

3. The facemask having an aromatic capsule as claimed in claim 1, further comprises a fixer for fixing said at least one press-to-crack aromatic capsule.

4. The facemask having an aromatic capsule as claimed in claim 3, further comprises a bridge attachment piece disposed at an upper edge of said mask body, wherein said fixer is in a transverse bar shape to wrap around and hold fixed said at least one aromatic capsule adjacent opposing ends of said bridge attachment piece or at a location to correspond with a user's nostrils.

5. The facemask having an aromatic capsule as claimed in claim 1, wherein said at least one aromatic capsule contains a fragrance component able to adsorb and dissolve unfavorable odors.

6. The facemask having an aromatic capsule as claimed in claim 1, wherein said at least one aromatic capsule contains a revitalizing fragrance component.

7. The facemask having an aromatic capsule as claimed in claim 1, further comprises a bridge attachment piece disposed at an upper edge of said mask body, said at least one aromatic capsule being fixed at opposing ends of said bridge attachment piece or fixed adjacent to a location corresponding with a user's nostrils.

* * * * *